US006082732A

United States Patent [19]

Hutchison et al.

[11] Patent Number: 6,082,732

[45] Date of Patent: Jul. 4, 2000

[54] SYSTEM FOR DETECTING SUPERPOSED SHEETS

[75] Inventors: Brian G. Hutchison; Eric G. Lyons, both of Dundee, United Kingdom

[73] Assignee: NCR Corporation, Dayton, Ohio

[21] Appl. No.: 09/122,506

[22] Filed: Jul. 24, 1998

[30] Foreign Application Priority Data

Nov. 5, 1997 [GB] United Kingdom ..... 9723306

[51] Int. Cl.[7] ..... B65H 7/02

[52] U.S. Cl. ..... 271/265.04; 250/559.01; 250/559.1; 250/559.27

[58] Field of Search ..... 250/559.01, 559.1, 250/559.12, 559.39, 559.27, 559.2; 271/265.04, 263, 262

[56] References Cited

U.S. PATENT DOCUMENTS

| | | | |
|---|---|---|---|
| 3,614,419 | 10/1971 | Daughton et al. . | |
| 4,154,437 | 5/1979 | Butcheck et al. . | |
| 4,652,742 | 3/1987 | Wauer et al. | 271/263 |
| 5,067,704 | 11/1991 | Tsuihiji et al. | 271/263 |
| 5,502,312 | 3/1996 | Lorenzo | 250/559.1 |
| 5,693,931 | 12/1997 | Wade | 250/559.1 |
| 5,806,843 | 9/1998 | Hansen et al. | 271/263 |

FOREIGN PATENT DOCUMENTS

| | | | |
|---|---|---|---|
| 0103153 | 3/1984 | European Pat. Off. . | |
| 0149699 | 7/1985 | European Pat. Off. | 271/263 |
| 0344938 | 12/1989 | European Pat. Off. . | |
| 362116442 | 5/1987 | Japan | 271/265.04 |
| 2244261 | 11/1991 | United Kingdom . | |

OTHER PUBLICATIONS

W. A. Boothroyd, "Double Document Detect System", IBM Technical Disclosure Bulletin, vol. 19, No. 12, May 1977, pp. 4749–4750, XP002104358, New York US.

Patent Abstracts of Japan, vol. 013, No. 154 (M–814), Apr. 14, 1989 & JP 63 315441 A (Konica Corp), Dec. 23, 1988.

*Primary Examiner*—H. Grant Skaggs
*Attorney, Agent, or Firm*—Gregory A. Welte

[57] ABSTRACT

A system for detecting the passage of superposed notes along a feed path. The system includes a sensing station (12) through which the feed path passes and which has a filament lamp (48) and an optical sensor (50). The magnitude of an output signal of the optical sensor is dependent on the intensity of the received light. A microcontroller (52) establishes a threshold value of the output signal by setting the intensity of light emitted from the lamp, when there is no note in the sensing station, to a first level. A pulse width modulator (56) increases the intensity of emitted light from the first level to a second level so that when there is one note present at the sensing station the output signal is above the threshold level. The intensity of emitted light is maintained at the second level whereby superposed notes cause a substantial fall in the output signal of the optical sensor. The microcontroller monitors the output signal to detect this. This system can be used in place of more complicated and expensive superposed sheet detect systems such as those incorporating co-operating rollers.

8 Claims, 3 Drawing Sheets

SYSTEM FOR DETECTING SUPERPOSED SHEETS

BACKGROUND OF THE INVENTION

This invention relates to an apparatus for detecting the passage of superposed sheets along a feed path. The invention has application, for example, to an apparatus for detecting the passage of superposed currency notes in an automated teller machine (ATM).

In a cash dispensing mechanism of an ATM, it is important to provide a simple and reliable means for detecting when a currency note has become superposed on another in a path of travel from a currency supply means to a note exit slot, since such superpositioning may produce an undesirable result such as the dispensing of an excessive amount of money. For convenience, two or more sheets or notes which have become superposed will hereinafter be referred to as a multiple sheet or a multiple note.

A known system for detecting multiple sheets includes a sensing station in a feed path for the sheets. The sensing station includes a light emitter and an optical sensor arranged to sense light from the emitter transmitted through an item comprising a single or multiple sheet present at the sensing station. The optical sensor provides an output voltage whose magnitude is dependent on the intensity of the transmitted light received by the optical sensor. The output voltage of the optical sensor is applied to a processing circuit, and on the basis of this voltage the processing circuit provides an output indicative of whether a single sheet or a multiple sheet is present at the sensing station.

With this known system problems have been experienced in reliably distinguishing between a single bank note and a double bank note.

Referring to FIG. 1, the output of an optical sensor as a result of light incident on it varies exponentially with changes in transmissivity across a gap between a light emitter and the optical sensor. Point A on the graph represents the sensor output when there is no note present between the sensor and the emitter, point B represents the sensor output when there is one note present between the sensor and the emitter, and point C represents the sensor output when there are two notes present between the sensor and the emitter. It is seen that there is a relatively large difference between the sensor outputs for when there is no note present and when there is one note present, but that there is a relatively small difference between the sensor outputs for when there is one note present and when there are two notes present. Thus, there is not a very clearly defined difference as regards the sensor output for single and multiple notes. Also, the very low sensor output for a multiple note may approach the noise level of an analog-to-digital (A/D) converter included in the circuit used to process the output of the sensor.

Another known system for detecting multiple sheets is disclosed, for example, in EP-B-0344938 (Proprietor: NCR International, Inc.). This system includes first and second co-operating rollers between which sheets pass as they are fed along a feed path, the first roller having a fixed axis of rotation, and the second roller being resiliently urged towards the first roller so as to enable it to be moved away from the first roller as a single or multiple sheet passes between the rollers. A voltage generating means associated with the second roller produces an output voltage which varies linearly with movement of the second roller towards or away from the first roller, and this output voltage is applied to a processing circuit which determines whether a single or multiple sheet has passed between the rollers. This known system has the disadvantage that it is relatively complicated compared with the known multiple sheet detector system using an optical sensor.

SUMMARY OF THE INVENTION

It is an object of the invention to provide a system for detecting multiple sheets which is of simple construction and in which the above-mentioned problems of the known system employing an optical sensor are alleviated.

According to one aspect of the present invention there is provided a method for detecting the passage of superposed sheets along a feed path through a sensing station which comprises light emitting means and an optical sensing means, where an output signal is provided from said optical sensing means whose magnitude is dependent on the intensity of the received light, characterized by the steps of establishing a threshold value of said output signal by setting the intensity of emitted light, when there is no sheet in the sensing station, to a first level; increasing the intensity of emitted light to a second level so that, when there is one sheet in the sensing station, the output signal approximates the threshold value; maintaining the intensity at said second level, whereby superposed sheets cause a substantial fall in the output signal; and monitoring the output signal.

According to another aspect of the present invention there is provided a system for detecting the passage of superposed sheets along a feed path, said system including a sensing station through which said feed path passes and which comprises light emitting means and an optical sensing means, the magnitude of an output signal of said optical sensing means being dependent on the intensity of the received light, characterized by light emitting controlling means that increases the intensity of emitted light from a first level to a second level so that, when there is one sheet present at said sensing station, the output signal approximates a threshold level, and maintains the intensity at said second level; and data processing means which establishes said threshold value of said output signal by setting the intensity of emitted light, when there is no sheet in the sensing station, to said first level, and monitors the output signal of said optical sensing means.

BRIEF DESCRIPTION OF THE DRAWINGS

One embodiment of the invention will now be described by way of example with reference to the accompanying drawings in which.

DETAILED DESCRIPTION

Figure 2:
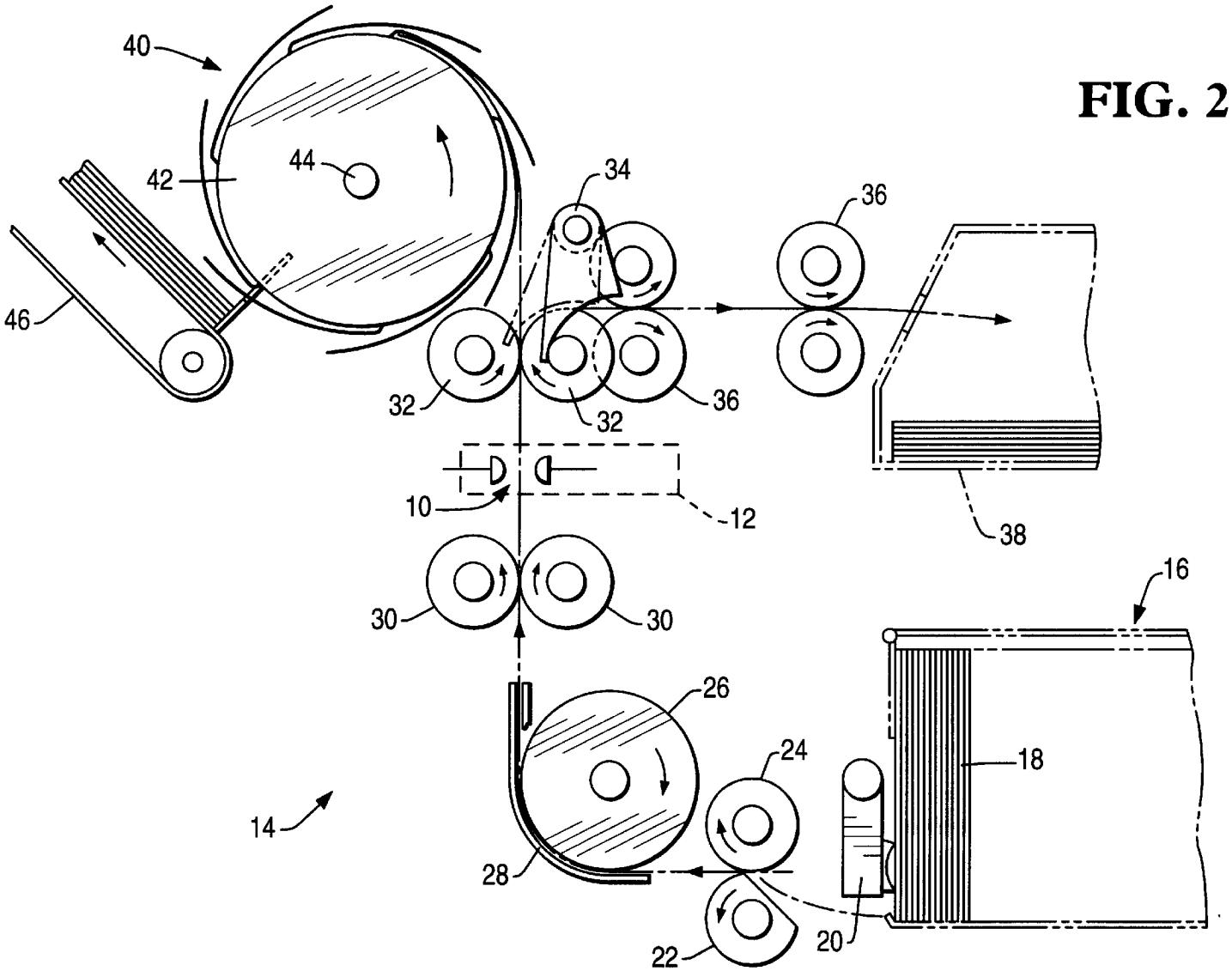
FIG. 2 is a schematic view of part of a cash dispensing mechanism including a multiple note detecting system in accordance with the present invention.

Referring now to FIG. 2, the multiple note detecting means includes an optical system 10 provided at a sensing station 12 included in a cash dispensing mechanism 14 of an ATM. The cash dispensing mechanism 14 includes a currency cassette 16 arranged to contain a stack of currency notes 18 of the same pre-determined denomination supported on their long edges. The cassette 16 is associated with a pick mechanism 20. When one or more currency notes are to be dispensed from the cassette 16 in the course of a cash dispensing operation, the pick mechanism 20 draws out notes one by one from the stack 18, and each note is fed by feed rolls 22,24,26 via guide means 28 to feed rolls 30. The direction of feed of the notes is at right angles to their long dimensions. It should be understood that the cash dispensing mechanism 14 could include more than one cassette each associated with a pick mechanism, but in the present embodiment only one cassette and pick mechanism will be described.

Each picked note is passed through the sensing station 12 by the feed rolls 30 and by further feed rolls 32. If a multiple note is detected by the optical system 10 (in a manner to be described in more detail later) then a divert gate 34 diverts the multiple note via rolls 36 into a reject bin 38.

If a single note is detected then the note passes on to a stacking wheel 40 to be loaded on to stationary belt means 46. The stacking wheel 40 comprises a plurality of stacking plates 42 spaced apart in parallel relationship along the shaft 44 of the stacking wheel 40. When the required number of notes have been loaded on to the belt means 46, the belt means 46 transports the notes to a cash delivery slot (not shown).

Figure 3:
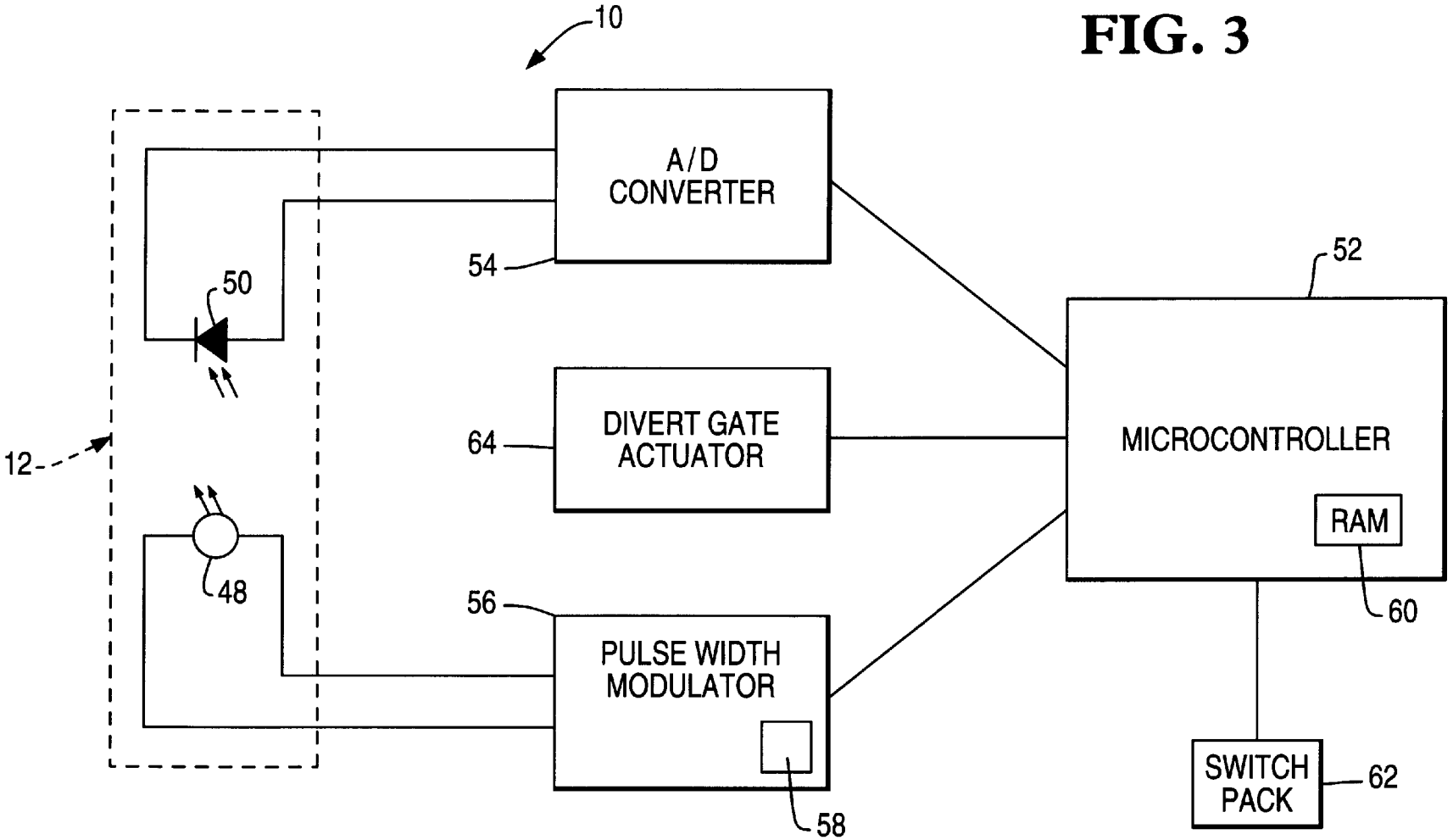
FIG. 3 is a schematic representation of the multiple note detecting system.

Referring to FIG. 3, the optical system 10 comprises a filament lamp 48 as a light emitter and an optical sensor 50 in the form of a photo-diode or a photo-transistor. The optical sensor 50 is connected to a microcontroller 52 via an analog-to-digital (A/D) converter 54. This allows the microcontroller 52 to read a digital value that is directly proportional to the amount of light falling on the sensor 50. Also connected to the microcontroller 52 is a pulse width modulator 56 which drives the filament lamp 48. The pulse width modulator 56 runs at a constant frequency. In this embodiment the frequency is 20 KHz. However, the duty cycle of the lamp can be varied from 0% to 100% by the microcontroller 52 writing a control value to a control register 58 of the pulse width modulator 56. By varying the duty cycle the output of the lamp 48 can be varied from no light to full output. Since the frequency response of the lamp 48 is very low no flickering effect occurs in the output of the lamp 48.

Although the microcontroller 52, the A/D converter 54 and the pulse width modulator 56 are shown as separate units in FIG. 3, a microcontroller can have the A/D converter and the pulse width modulator integrated onto one integrated circuit. Such a microcontroller is the Philips 80C562 which can be obtained from Philips Semiconductors Limited, Bath Road, Hayes, Middlesex, United Kingdom.

Before use the optical system 10 must be calibrated for a particular bill type by ndividually passing new single notes between the filament lamp 48 and the optical sensor 50.

Figure 1:
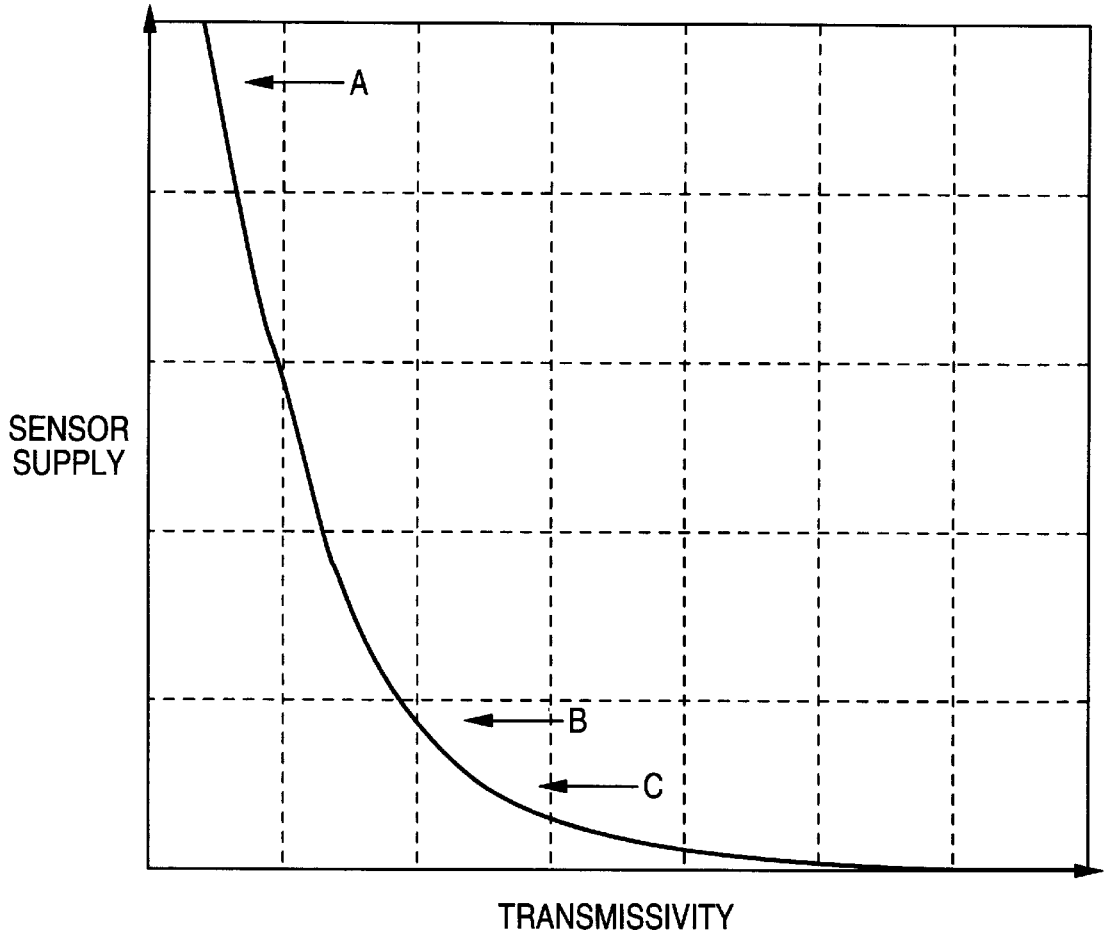

Initially there is no note between the filament lamp 48 and the optical sensor 50 and the control register 58 of the pulse width modulator 56 contains a default value. This default value is such that the pulse width modulator causes initial brightness of the lamp 48 to be well below its maximum level. The brightness of the lamp 48 is adjusted by the microcontroller 52 until the output of the A/D converter 54 is almost full scale. This is represented by point A on FIG. 1. The A/D converter 54 in this embodiment is an 8 bit converter. Thus, the full scale output would be FF hex or 255 decimal. The microcontroller 52 stores a threshold value in its random access memory (RAM) 60 which is slightly below FF hex. When a single note passes through the optical system 10 the output of the sensor 50 falls to point B on FIG. 1 which produces an output from the A/D converter 54 which is considerably below the threshold value. This is detected by the microcontroller 52 repeatedly reading the output of the A/D converter 54. The microcontroller 52 now increases the brightness of the lamp thereby increasing the output from the sensor 50 back towards point A of FIG. 1 so that the output of the A/D converter 54 is as high as possible (i.e. approaching FF hex) and is above the threshold value. Small changes in transmissivity will now result in large changes in the output of the A/D converter 54. The control value sent by the microcontroller 52 to the control register 58 of the pulse width modulator 56 to achieve this new brightness is known as the calibration value.

This process can be repeated several times for single notes so that a more accurate calibration value can be achieved. One way of achieving this is for the microcontroller 52 to compare the output from the sensor 50 with the threshold value and if the output from the A/D converter 54 falls below the threshold value then the microcontroller 52 increases the calibration value accordingly.

Alternatively the calibration value could be entered manually into the pulse width modulator 56 via a switch pack 62 that is connected to the microcontroller 52. By setting a combination of switches the calibration value can be changed.

The operation of the optical system 10 when it is being used to check for multiple notes will now be described. When a single note is passed between the filament lamp 48 and the sensor 50 the output of the A/D converter 54 is close to FF hex. If this output is above the threshold value then the microcontroller 52 accepts the note being passed through as a single note. If a multiple note is passed between the lamp 48 and the sensor 50 the output of the sensor 50 falls significantly. If the multiple note is a double note, the output falls to point B on FIG. 1, and if the multiple note consisted of more notes than this then the output falls to a point below point B. Thus it can be seen that there is a significant difference between the output from the sensor 50 (and hence the A/D converter 54) for a single note and a multiple note.

It will be understood that, in a normal pick operation, the pick mechanism 20 picks a single currency note from the currency cassette 16 for feeding to the stacking wheel 40 (see FIG. 2). If the microcontroller 52 determines that a single note has been sensed, then the divert gate 34 remains in its home position as shown in solid outline in FIG. 2, thereby enabling the note to be fed to the stacking wheel 40 for stacking on the belt means 46 and transportation to the cash delivery slot. If a multiple note is detected, then the microcontroller 52 sends a signal to an actuator 64 such as a solenoid that moves the gate 34 into its activated position shown in chain outline in FIG. 2 so that the multiple note is diverted into the reject bin 38.

The system 10 can also be made to self adjust for dirt and aging by allowing the microcontroller 52 to vary the calibration value slightly if the output of the sensor 50 is less than expected for a particular calibration value stored in the control register 58 of the pulse width modulator 56.

Although the system described uses a microcontroller 52, the central processing unit of the ATM in which the system is installed could be set up to include performing the function of the microcontroller 52. The filament lamp 48 could be replaced by a light emitting diode but filtering would then be required.

The system described above can reliably distinguish between single and multiple notes and can be used in place of more complicated and expensive multiple sheet detect systems such as those incorporating co-operating rollers.

What is claimed is:

1. A method of detecting the passage of superposed sheets along a feed path through a sensing station which includes a light emitter and an optical sensor which provides an output signal having a magnitude which is dependent on the intensity of light received from the light emitter, the method comprising the steps of:

(a) establishing a threshold value of the output signal by setting the intensity of emitted light, when there is no sheet in the sensing station, to a first level;

(b) increasing the intensity of emitted light to a second level so that, when there is one sheet in the sensing station, the output signal approximates the threshold value;

(c) maintaining the intensity at the second level; and (d) monitoring the output signal to detect the passage of superposed sheets along the feed path.

2. A method according to claim 1, further comprising the step of:

(e) storing a calibration value that sets the second level of intensity of light emitted by the light emitter.

3. A method according to claim 2, wherein the calibration value is determined by passing at least one individual sheet through the sensing station.

4. A method according to claim 2, wherein the calibration value is entered via an input device.

5. A method according to claim 2, wherein the calibration value can be adjusted during the detection of the passage of superposed sheets if the output from the optical sensor is consistently below a value expected for a single sheet.

6. A system for detecting the passage of superposed sheets along a feed path, the system comprising:

a sensing station through which the feed path passes, the sensing station including light emitting means and optical sensing means, the magnitude of an output signal of the optical sensing means being dependent on the intensity of the received light;

light emitting controlling means for (i) increasing the intensity of emitted light from a first level to a second level such that, when there is one sheet present at the sensing station, the output signal approximates a threshold level, and (ii) maintaining the intensity at the second level; and data processing means for (i) establishing the threshold value of the output signal by setting the intensity of emitted light, when there is no sheet in the sensing station, to the first level, and (ii) monitoring the output signal of the optical sensing means to detect the passage of superposed sheets along the feed path.

7. A system according to claim 6, wherein the output signal of the optical sensing means is applied to the data processing means via an analog-to-digital converter.

8. A system according to claim 7, wherein the light emitting controlling means is a pulse width modulator.

* * * * *